US007533701B2

(12) United States Patent
Gadzic et al.

(10) Patent No.: US 7,533,701 B2
(45) Date of Patent: May 19, 2009

(54) METHOD AND APPARATUS FOR THE STORAGE AND PRESERVATION OF LIQUIDS COMPOUNDS

(76) Inventors: Andrew Gadzic, 59-06 Decatur St., Ridgewood, NY (US) 11385; Samuel P. Laufer, 9 Pierrepont St., New York, NY (US) 11201; William S. Laufer, 2050 Pine St., Philadelphia, PA (US) 19103; Jack Laufer, 605 E. 82nd St., New York, NY (US) 10028

( * ) Notice: Subject to any disclaimer, the term of this patent is extended or adjusted under 35 U.S.C. 154(b) by 627 days.

(21) Appl. No.: 11/158,449

(22) Filed: Jun. 21, 2005

(65) Prior Publication Data

US 2006/0283523 A1 Dec. 21, 2006

(51) Int. Cl.
*B65B 31/08* (2006.01)
*B65B 3/04* (2006.01)
*B67C 3/06* (2006.01)

(52) U.S. Cl. ..... 141/54; 141/63; 141/302; 141/329

(58) Field of Classification Search ..... 141/4–6, 141/54, 63, 67, 91–92, 95, 301–302, 323, 141/329, 330
See application file for complete search history.

(56) References Cited

U.S. PATENT DOCUMENTS 2,584,397 A 2/1952 Pitman
3,490,437 A 1/1970 Bakondy et al.
3,879,295 A 4/1975 Glover et al.
3,883,043 A 5/1975 Lane
4,077,182 A 3/1978 Papaluca
4,187,890 A 2/1980 Stach et al.
4,296,785 A 10/1981 Vitello et al.
4,347,874 A 9/1982 Sullivan et al.
4,366,912 A * 1/1983 Matukura et al. ..... 215/247
4,434,823 A 3/1984 Hudspith
4,475,576 A 10/1984 Simon
4,477,477 A 10/1984 Arter (Continued)

OTHER PUBLICATIONS

"Winekeeper", downloaded from the web (address: http://www.winekeeper.com/01pages/products/keeper.html) (Oct. 8, 2003).

(Continued)

*Primary Examiner*—Timothy L Maust
*Assistant Examiner*—Nicolas A Arnett
(74) *Attorney, Agent, or Firm*—Leason Ellis LLP

(57) ABSTRACT

The present invention is directed to an apparatus for transferring a liquid from a source container to a destination container including a liquid transfer mechanism; at least one unidirectional valve preventing backflow into the source container; a source needle, inserted into a sealed closure of the source container, withdrawing the liquid from the source container; a destination needle, inserted into a sealed closure of the destination container, depositing the liquid into the destination container; an inert gas container supplying an inert gas to the source container; and at least one vent check valve releasing pressure from at least one of the containers when the pressure in the container exceeds a predetermined pressure limit. The present invention transfers liquids such as wine from an original sealed container into various new containers under controlled conditions without compromising the original composition of the liquids.

15 Claims, 3 Drawing Sheets

U.S. PATENT DOCUMENTS

| | | | | | |
|---|---|---|---|---|---|
| 4,509,534 | A | | 4/1985 | Tassin, Jr. | |
| 4,583,346 | A | * | 4/1986 | Kameda | 53/431 |
| 4,595,121 | A | | 6/1986 | Schultz | |
| 4,624,391 | A | | 11/1986 | Shannon | |
| 4,702,396 | A | | 10/1987 | Gwiazda | |
| 4,706,847 | A | | 11/1987 | Sankey | |
| 4,715,187 | A | * | 12/1987 | Stearns | 62/50.1 |
| 4,763,803 | A | | 8/1988 | Schneider | |
| 4,829,002 | A | | 5/1989 | Pattillo et al. | |
| 4,859,375 | A | * | 8/1989 | Lipisko et al. | 261/20 |
| 4,937,194 | A | | 6/1990 | Pattillo et al. | |
| 5,186,362 | A | | 2/1993 | Biagi, Jr. | |
| 5,215,129 | A | | 6/1993 | Berresford et al. | |
| 5,267,964 | A | | 12/1993 | Karg | |
| 5,289,858 | A | | 3/1994 | Grabenkort | |
| 5,297,561 | A | | 3/1994 | Hulon | |
| 5,466,220 | A | | 11/1995 | Brenneman | |
| 5,791,466 | A | | 8/1998 | Tsals | |
| 5,885,270 | A | | 3/1999 | Ortiz et al. | |
| 6,021,824 | A | | 2/2000 | Larsen et al. | |
| 6,349,850 | B1 | | 2/2002 | Cheikh | |
| 6,360,784 | B1 | | 3/2002 | Philippens et al. | |
| 6,425,421 | B1 | | 7/2002 | Morrison | |
| 6,530,401 | B1 | | 3/2003 | Angehrn et al. | |
| 6,557,459 | B1 | | 5/2003 | Phelps et al. | |
| 6,604,561 | B2 | * | 8/2003 | Py | 141/329 |
| 6,607,100 | B2 | | 8/2003 | Phelps et al. | |
| 6,607,105 | B2 | | 8/2003 | Phelps et al. | |
| 6,689,108 | B2 | * | 2/2004 | Lavi et al. | 604/211 |
| 7,182,110 | B2 | * | 2/2007 | Roebuck | 141/302 |

OTHER PUBLICATIONS

"Brentwood Wine Company", downloaded from the web(address: http://brentwoodwine.com/invest/storing.html) (Sep. 16, 2003).

* cited by examiner

METHOD AND APPARATUS FOR THE STORAGE AND PRESERVATION OF LIQUIDS COMPOUNDS

TECHNICAL FIELD

The present invention relates to transferring liquids and, more particularly, to the storage and preservation of liquids.

BACKGROUND

Bottles of wine are typically sealed using a cork or other type of closure. However, once the cork is removed and the seal is broken, the wine may be exposed to oxygen, which leads to oxidation, and biological contaminants. The exposure of the liquid to oxygen and/or biological contamination changes the chemical properties of the liquid, possibly rendering the liquid unsuitable for use.

A conventional method for preserving liquids is to introduce a vacuum into the bottle. However, the quality of the liquid may be reduced when using a vacuum. The liquid may contain volatile compounds which, due to their nature and to their reduced vapor pressure, may more rapidly evaporate in atmospheres having a pressure of less than approximately 15 psi (1 atm). This evaporation can change the characteristics of the liquid by altering its composition.

What has heretofore not been available is an alternative method and apparatus for preserving and storing liquids, especially liquids with volatile compounds such as wine, that prevents the exposure to oxygen, that reduces the risk of biological contamination, and that prevents the rapid evaporation of the liquid.

SUMMARY OF THE INVENTION

According to an embodiment of the present invention, an apparatus for transferring a liquid from a source container to a destination container includes a liquid transfer mechanism transferring the liquid from the source container to the destination container; at least one unidirectional valve between the source container and the destination container preventing backflow into the source container; a source needle, inserted into a sealed closure of the source container, withdrawing the liquid from the source container; a destination needle, inserted into a sealed closure of the destination container, depositing the liquid into the destination container; an inert gas container supplying an inert gas to the source container; and at least one vent check valve releasing pressure from at least one of the source container and the destination container when the pressure in the respective container exceeds a predetermined pressure limit. The source needle and the destination needle are connected to the liquid transfer mechanism to transfer the liquid from the source container to the destination container.

The destination container is hermetically sealed, sterilized, and contains the inert gas, according to an embodiment of the present invention.

The apparatus, according to an embodiment of the present invention, includes a needle actuation and support assembly including a guide assembly head attached to a controlled needle, the controlled needle being one of the source needle and the destination needle; a slide guiding the guide assembly head and allowing the guide assembly head and the controlled needle to move in a linear direction; and an actuator driving the guide assembly head so that the controlled needle is driven into the sealed closure of one of the source container and the destination container.

The apparatus, according to an embodiment of the present invention, includes a needle assembly guide including a needle guide guiding the controlled needle into the sealed closure of one of the source container and the destination container; the guide assembly head driving a spring to position the needle guide against one of the source container and the destination container; and at least one guide post guiding the controlled needle during insertion into the sealed closure of one of the source container and the destination container.

The apparatus, according to an embodiment of the present invention, includes a cap assembly mounted to the destination container, the cap assembly including a septum closing the destination container and allowing the transfer of liquid via the destination needle inserted through the septum; and an inner cap removably fixed to the destination container, supporting the septum, and holding the septum against the destination container.

The cap assembly of the destination container, according to an embodiment of the present invention, also includes an outer cap mounted on the inner cap and allowing simultaneous removal of the inner cap and the outer cap when the liquid is dispensed from the destination container; and a secondary seal disposed between the inner cap and the outer cap.

The predetermined pressure limit can be approximately 15 psi.

The apparatus, according to an embodiment of the present invention, includes an inert gas supply regulator, connected between the inert gas container and the source container, maintaining the supply of the inert gas at approximately 15 psi.

The apparatus, according to an embodiment of the present invention, includes a control system controlling the actuator to control movement of the controlled needle.

The apparatus, according to an embodiment of the present invention, includes a control system controlling a main inert gas valve connected between the inert gas container and the source container to control flow of the inert gas into the source container.

According to an embodiment of the present invention, a method of transferring wine from a source container to a destination container includes the steps of inserting a source needle into a sealed closure of the source container; withdrawing the wine from the source container using the source needle; transferring the wine from the source needle to the destination needle; preventing backflow into the source container; inserting a destination needle into a sealed closure of the destination container; depositing the wine into the destination container using the destination needle; and supplying an inert gas to the source container at a predetermined pressure.

According to an embodiment of the present invention, an apparatus for transferring wine from a source container to a destination container, includes a liquid transfer mechanism transferring the wine from the source container to the destination container; at least one unidirectional valve between the source container and the destination container preventing backflow into the source container; a source needle, inserted into a sealed closure of the source container, withdrawing the wine from the source container; and a destination needle, inserted into a sealed closure of the destination container, depositing the wine into the destination container. The source needle and the destination needle are connected to the liquid transfer mechanism to transfer the wine from the source container to the destination container.

BRIEF DESCRIPTION OF THE DRAWINGS

The foregoing and other features of the present invention will be more readily apparent from the following detailed description and drawings of the illustrative embodiments of the invention wherein like reference numbers refer to similar elements and in which.

DETAILED DESCRIPTION OF THE PREFERRED EMBODIMENTS

FIGS. 1-3B illustrate an embodiment of an apparatus 1 for storing and preserving liquids such as wine according to the present invention. Other liquids may also be stored and preserved using the apparatus described herein; however, it is particularly advantageous to use such an apparatus for liquids with volatile compounds that diminish in quality after exposure to oxygen and/or biological contamination and that can rapidly evaporate without proper care to the design of the storage and preservation apparatus.

Figure 1:
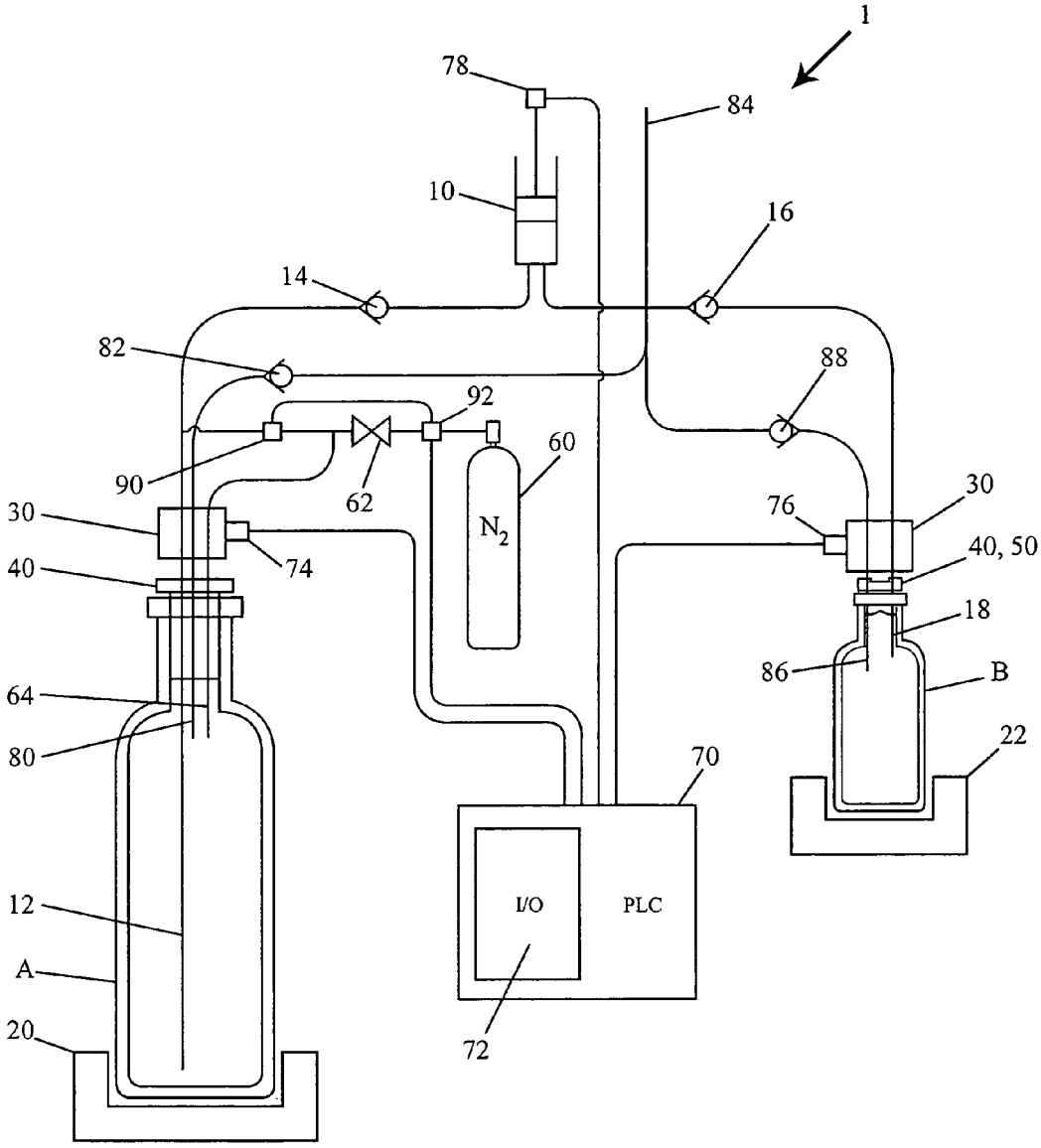
FIG. 1 is a schematic of an apparatus for storing and preserving liquids according to an embodiment of the present invention.

FIG. 1 illustrates a schematic of the storage and preservation apparatus 1 for storing and preserving liquids according to an embodiment of the present invention. The storage and preservation apparatus 1 is used to transfer a liquid stored in a source bottle A into one or more hermetically sealed, sterilized destination bottles B. The destination bottle B is specially prepared, has a controlled environment, and is filled with an inert gas, e.g., nitrogen, at approximately 15 psi (1 atm). It is to be understood that the term "bottle" is not limited to "a rigid or semirigid container of glass or plastic having a comparatively narrow neck or mouth and usually no handle," but can refer broadly to containers of various shapes and sizes.

The wine is transferred from the source bottle A to the destination bottle B using a fluid transfer system. The fluid transfer system includes a pump 10, a source intake needle 12, a source side fluid check valve 14, a destination side fluid check valve 16, and a destination needle 18.

The pump 10 transfers the fluid from the source bottle A to the destination bottle B. Various types of pumps may be used, such as a syringe-like device, but a peristaltic pump is preferred since it is less aggressive with the liquid that it is transferring and allows for the replacement of certain pump components to prevent contamination. Allowing the replacement of certain components of the pump rather than requiring the replacement of the entire pump is economically advantageous.

The source intake needle 12 is a needle that is inserted into the source bottle A to withdraw liquid from the source bottle A. As used herein, the term "needle" refers broadly to a slender hollow device used to introduce matter, e.g., liquid or gas, into or remove matter from an object, but also applies more broadly to a tube or hollow elongated cylinder.

The source side fluid check valve 14 is a unidirectional valve that prevents the liquid that is transferred from returning to the source bottle A. The source side fluid check valve 14 also prevents other fluids from entering the source bottle A from the destination side of the source side fluid check valve 14.

The destination side fluid check valve 16 is a unidirectional valve that prevents the liquid that is transferred from returning to the source bottle A or the pump 10. The destination side fluid check valve 16 also prevents other fluids from entering the source bottle A from the destination side of the destination side fluid check valve 16.

The destination needle 18 is a needle that is used to transfer liquid into the destination bottle B.

Thus, when fluid is transferred from the source bottle A to the destination bottle B, the fluid is withdrawn using the pump 10 via the source intake needle 12 from the source bottle A. The fluid travels via tubes from the source bottle A to the destination bottle B. The tubes connect the source intake needle 12, source side fluid check valve 14, pump 10, destination side fluid check valve 16, and the destination needle 18, as shown in FIG. 1.

After leaving the source bottle A, the fluid passes through the source side fluid check valve 14. After the fluid passes through the unidirectional source side fluid check valve 14, it is prevented from flowing back toward the source bottle A.

The fluid then travels toward the pump 10, the destination side fluid check valve 16, and the destination bottle B. The fluid travels through the pump 10 immediately following the source side fluid check valve 14. As stated above, various types of pumps can be used, such as piston or vane, but due to the possibility of contamination when switching over from one source bottle to another, a peristaltic pump with disposable tubing is preferred. The type of pump 10 used in the present invention is also preferably the least aggressive to the fluid being transferred.

Before the destination bottle B and immediately following the pump 10 is a second unidirectional valve, the destination side fluid check valve 16. After the fluid passes through the pump 10 and the destination side fluid check valve 16, the fluid is prevented by the destination side fluid check valve 16 from flowing back toward the source bottle A or the pump 10. Thus, the source side and destination side fluid check valves 14, 16 help to control the direction of flow of the fluid from the source bottle A to the destination bottle B to ensure that there is no backflow toward the source bottle A. The valves 14, 16 prevent the source fluid from traveling through the system incorrectly.

After passing through the destination side fluid check valve 16, the fluid is transferred through another tube, into the destination needle 18, and then into the destination bottle B. After the destination bottle B is filled, it is removed and another destination bottle is inserted until the fluid in the source bottle A is exhausted.

The storage and preservation apparatus 1 includes positioning, guidance, and actuation systems for positioning the source bottle A, the destination bottle B, the source intake needle 12, and the destination needle 18. The positioning, guidance, and actuation systems include a source bottle chuck 20, a destination bottle chuck 22, a needle actuation and support assembly 30, a needle assembly guide 40, and a destination bottle cap assembly 50.

The source bottle chuck 20 is a mechanism that utilizes jaws (not shown) to help center the source bottle A before any needles, e.g., the source intake needle 12, a nitrogen supply needle 64 (FIG. 1, described below), and a source vent needle 80 (FIG. 1, described below), are inserted. The destination bottle chuck 22 is a mechanism that utilizes jaws (not shown) to help center the destination bottle B before any needles, e.g., the destination needle 18 and the destination vent needle 86, are inserted. The sets of jaws position the respective bottles A, B and accommodate for various bottle diameters.

Figure 2:
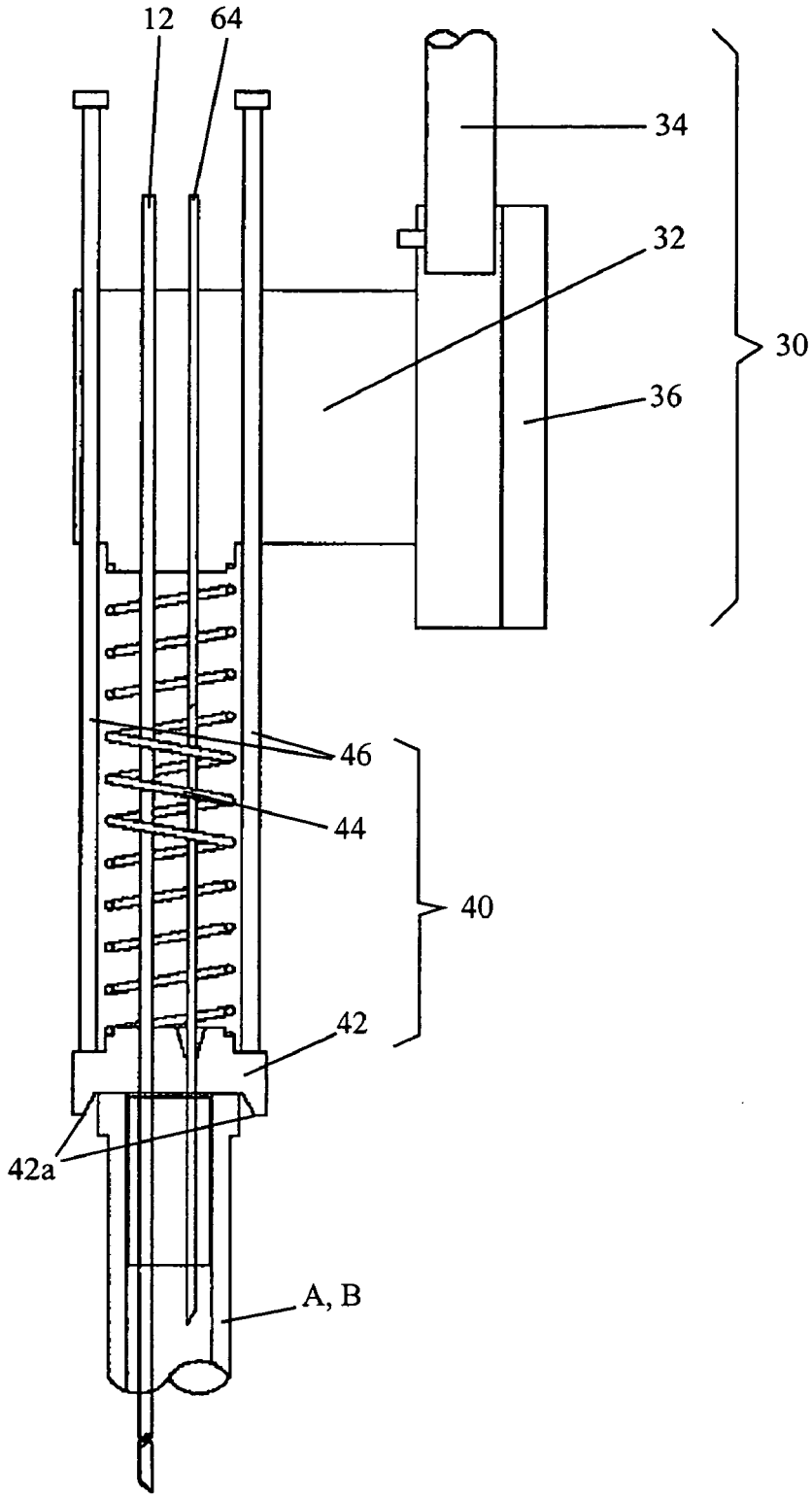
FIG. 2 is a front sectional view of a needle actuation and support assembly and a needle assembly guide of the storage and preservation apparatus of FIG. 1.

FIG. 2 is a front sectional view of the needle actuation and support assembly 30 and the needle assembly guide 40 of the storage and preservation apparatus 1. The needle actuation and support assembly 30 and the needle assembly guide 40 can be provided for each bottle A, B. The installation of the needle actuation and support assembly 30 and the needle assembly guide 40 is described below in relation to the source bottle A; however, it is to be understood that the needle actuation and support assembly 30 and the needle assembly guide 40 are installed in a similar manner for the destination bottle B.

The fluid transfer is performed after inserting the needles, e.g., the source intake needle 12, the nitrogen supply needle 64, and the source vent needle 80, into the source bottle A using the needle actuation and support assembly 30 and the needle assembly guide 40. The needle actuation and support assembly 30 includes a guide assembly head 32, an actuator 34, and a slide 36.

The guide assembly head 32 is the main body attached to the needles and the actuator 34. The guide assembly head 32 moves linearly by sliding against the slide 36.

The actuator 34 is the mechanism that provides energy to drive the needles into the source bottle A. The actuator 34 can be of various types such as a hydraulic cylinder or piston using fluid power or a motor and lead screw using electrical power. The actuator 34 is controlled either manually or electrically by a main control system, e.g., a programmable logic controller (PLC) 70, as described below.

The slide 36 is the mechanism that allows the guide assembly head 32 to move. The slide 36 can include various types of components such as a dovetail or linear rail to allow for a sliding, linear movement of the guide assembly head 32.

The guide assembly head 32 is mounted to the storage and preservation apparatus 1 using the slide 36, which allows linear motion via the dovetail or linear rail. The actuator 34 is then fixed to the guide assembly head 32 and provides the force necessary to insert the needles into the source bottle A.

The closure of the source bottle A may be formed of a cork, a cap, or another type of bottle closing device. When the needle actuation and support assembly 30 is provided for the destination bottle B, the destination bottle B, as described below, is closed by the destination bottle cap assembly 50.

Due to the forces required to drive the needles through the closure of the source bottle A, the needle assembly guide 40 can be used to ensure the proper placement of the needles. The needle assembly guide 40 includes a needle guide 42, a spring 44, and guide posts 46.

The needle assembly guide 40 is passive and works in conjunction with the needle actuation and support assembly 30. The needle guide 42 contacts the top of the source bottle A when using the needle actuation and support assembly 30 and supports the needles as they puncture the closure of the source bottle A.

The needle guide 42 aids in the guidance of the needles into the source bottle A. The needle guide 42 also helps to center the top of the source bottle A prior to insertion of the needles into the source bottle A. Furthermore, the needle guide 42 can include a taper 42*a* on its bottom peripheral edge so that the source bottle A can be centered before insertion of the needles.

The spring 44 provides the force necessary to maintain the needle guide 42 at the top of the source bottle A before and after insertion of the needles into the source bottle A.

The guide posts 46 help to guide the needles during insertion, thereby providing added strength to the needles. The guide posts 46 can take on various forms such as a shaft or linear rails.

The needle assembly guide 40 guides the needles. However, other tubes and/or needles may be included that are capable of piercing the various types of closures that may be found on the source bottle A. The tubes and needles can be formed from various materials and configurations depending on the type of closure to be breached on the source bottle A.

Figure 3A:
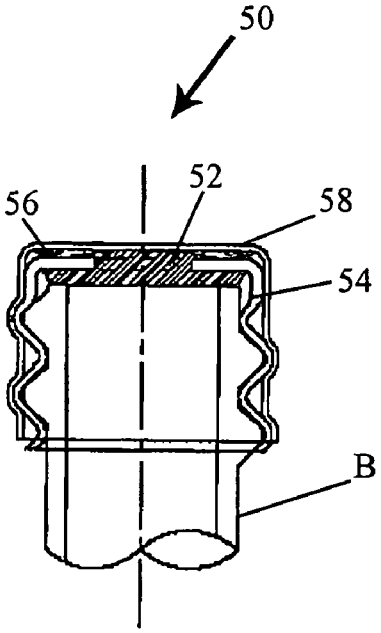
FIG. 3A is a front sectional view of a destination bottle cap assembly of the storage and preservation apparatus of FIG. 1.
Figure 3B:
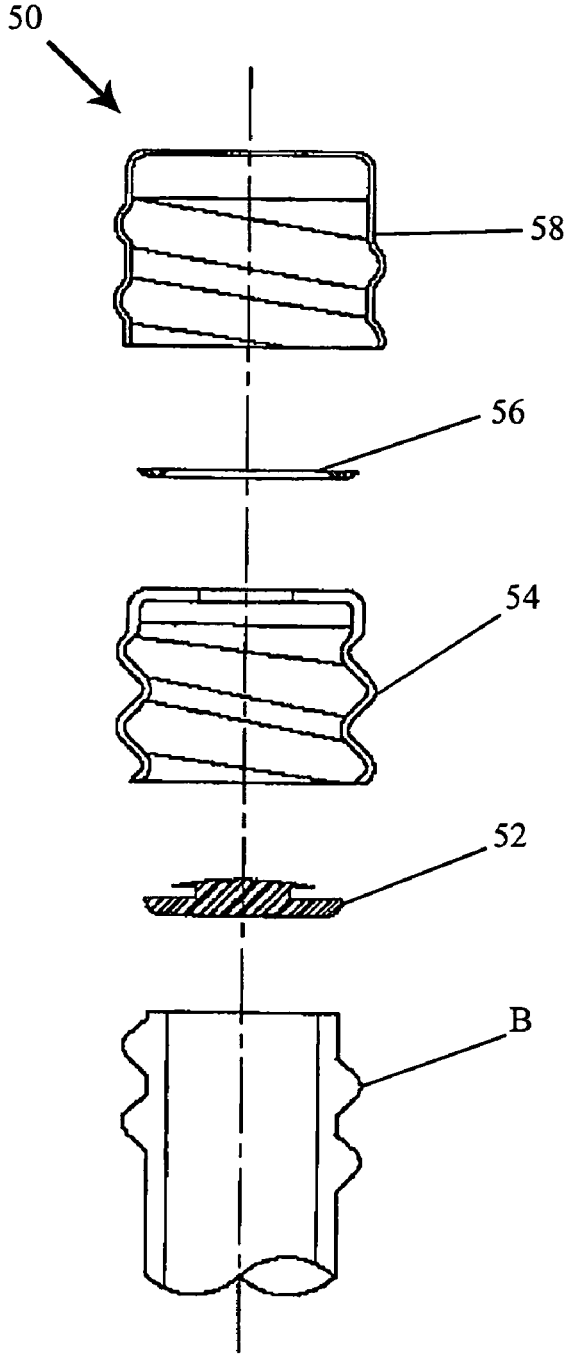
FIG. 3B is an exploded front sectional view of the destination bottle cap assembly of FIG. 3A.

FIG. 3A is a front sectional view of the cap assembly 50 of the destination bottle B of the storage and preservation apparatus 1, and FIG. 3B is an exploded front sectional view of the destination bottle cap assembly 50. The destination bottle cap assembly 50 covers the opening of the destination bottle B while still allowing for controlled transfer of the fluid into the destination bottle B and includes a septum 52, an inner cap 54, a secondary seal 56, and an outer cap 58.

The destination bottle B includes a threaded neck to allow closure between the destination bottle cap assembly 50 and the destination bottle B. The septum 52, the inner cap 54, the secondary seal 56, and the outer cap 58 are positioned on the destination bottle B in the order listed so that the septum 52 is the innermost element and the outer cap 58 is the outermost element of the assembly 50.

The destination bottle B, as stated above, is hermetically sealed, sterilized, and at a pure nitrogen atmosphere of approximately 15 psi. This pressure is maintained by the use of the septum 52. The septum 52 is a membrane, e.g., made of rubber, that can be breached by the destination needle 18 to allow the transfer of fluid into the destination bottle B yet provides instantaneous closure upon removal of the destination needle 18. Thus, the septum 52 is used to contain and prevent contamination of the destination bottle B while allowing the transfer of fluid. The septum 52 is integrated into the inner cap 54 and provides the main sealing capability between the destination bottle B and the inner cap 54.

The inner cap 54 is the main structure that supports the septum 52 and holds the septum 52 against the destination bottle B. The inner cap 54 interfaces with the threaded neck on the destination bottle B and provides the required force that the septum 52 needs to seal properly against the destination bottle B. The inner cap 54 also provides a convenient and simple way of removing the entire destination bottle cap assembly 50 when the liquid transferred to the destination bottle B is ready for dispensing.

The secondary seal 56 is a seal that is integrated into the underside of the outer cap 58 to provide additional sealing capabilities between the septum 52, the inner cap 54, and the outer cap 58.

The outer cap 52 protects and provides the force necessary to seal the destination bottle cap assembly 50. The outer cap 52 can be either threaded or pressed onto the inner cap 54 to form a complete closure and to protect the inner cap 54. This closure between the inner and outer cap 52, 54 provides for simultaneous removal of the outer cap 52 and the inner cap 54 when the wine transferred to the destination bottle B is ready for dispensing.

The transfer process for transferring the liquid from the source bottle A to the destination bottle B can be stopped either automatically by the control system (PLC 70) or manually, e.g., by a switch (non shown) connected to the pump 10. After stopping the transfer process, the destination bottle B can be removed from the apparatus 1 by removing the destination needle 18 and the destination vent needle 86 from the septum 52. Then, the outer cap 52 can be fastened onto the inner cap 54, e.g., by being threaded or pressed onto the inner cap 54, to seal the destination bottle B.

In order to prevent oxygen from entering the storage and preservation apparatus 1, nitrogen gas is supplied and regulated by a nitrogen system to maintain an inert atmosphere. Nitrogen is used for its high commercial availability and cost effectiveness, but other inert gases can be supplied.

As shown in FIG. 1, the nitrogen system includes a nitrogen cylinder 60, a nitrogen supply regulator 62, and the nitrogen supply needle 64. The nitrogen cylinder 60 is a container or cartridge for storing and dispensing nitrogen. The nitrogen supply needle 64 is a needle or tube that is used to equalize the pressure in the source bottle A by supplying nitrogen from the nitrogen cylinder 60. The nitrogen supply regulator 62 is a standard regulator used to maintain the supply of nitrogen from the nitrogen cylinder 60 to the source bottle A at approximately 15 psi.

Prior to the fluid transfer operation, nitrogen is used to purge all of the conduits, i.e., the tubes and needles, in the apparatus 1. Nitrogen is continually released during the insertion of the needles, e.g., the source intake needle 12, the nitrogen supply needle 64, and the source vent needle 80, into the source bottle A, thereby preventing oxygen from entering the apparatus 1.

Additionally, as the source bottle A is drained into the destination bottle B, nitrogen is supplied into the source bottle A at approximately 15 psi to maintain a neutral atmosphere and to prevent the creation of a vacuum. Although it is preferable to keep the liquid at approximately 15 psi, it is to be understood that the pressure may range from approximately 10 psi to approximately 20 psi to preserve the wine or other liquid. Outside of that pressure range, the wine begins to change. For example, if the pressure increases above 20 psi, nitrogen starts to dissolve into the wine, and if the pressure decreases below approximately 10 psi, the composition of the liquid starts to change, e.g., compounds within the liquid may begin to evaporate more rapidly.

The nitrogen system is controlled by means of valves and regulators, such as the nitrogen supply regulator 62, a nitrogen purge valve and control 90 (FIG. 1, described below), and a main nitrogen valve and control 92 (FIG. 1, described below), that can be either manually or electrically controlled.

As shown in FIG. 1, a control system of the storage and preservation apparatus 1 monitors the transfer of the fluid and meters a preset amount of the fluid into the destination bottle B. The control system includes the PLC 70 and input and output (I/O) 72, a source needle assembly actuation control 74, a destination needle assembly actuation control 76, a pump actuation and control 78, an over-pressurization prevention system (including a source vent needle 80, a source side vent check valve 82, an over-pressurization vent 84, a destination vent needle 86, and a destination side vent check valve 88), the nitrogen purge valve and control 90, and the main nitrogen valve and control 92.

The PLC 70 and I/O 72 represent the main control interface or control system of the storage and preservation apparatus 1. The PLC 70 and I/O 72 enable the programming of various parameters, monitoring of the apparatus 1 and the automatic control and execution of the various components of the apparatus 1.

The source needle assembly actuation control 74 is the control interface between the control system (PLC 70) and the needle actuation and support assembly 30 governing the insertion of the source intake needle 12, the nitrogen supply needle 64, and source vent needle 80 into the source bottle A. Thus, the PLC 70 can be programmed to control and monitor the insertion and removal of the needles into and out of the source bottle A.

The destination needle assembly actuation control 76 is the control interface between the control system (PLC 70) and the needle actuation and support assembly 30 governing the insertion of the destination needle 18 and destination vent needle 86 into the destination bottle B. Thus, the PLC 70 can be programmed to control and monitor the insertion and removal of the needles into and out of the destination bottle B.

The pump actuation and control 78 is the control interface between the control system (PLC 70) and the pump 10. The pump actuation and control 78 can be a switch if the pump 10 is actuated electrically or a valve/switch if the pump 10 is actuated by fluid. Thus, the PLC 70 can be programmed to control and monitor the actuation of the pump 10.

A passive valve system (the over-pressurization prevention system) prevents over-pressurization of either the source or destination bottle. This is accomplished by a dedicated set of check valves 82, 88 for the bottles A, B which discharge gas from the bottles A, B to the atmosphere via the over-pressurization vent 84 if the pressure inside the bottles A, B goes above approximately 15 psi (1 atm). The over-pressurization vent 84 is a common discharge point for the source side vent check valve 82 and the destination side vent check valve 88.

The source vent needle 80 is inserted into the source bottle A with the source intake needle 12 and the nitrogen supply needle 64. The source vent needle 80 can be integrated with the nitrogen supply needle 64 so that the needles 80, 64 are, e.g., bonded together and inserted into the source bottle A together. The source vent needle 80 is joined via tubing to the source side vent check valve 82 to prevent the over-pressurization of the source bottle A.

The destination vent needle 86 is inserted into the destination bottle B with the destination needle 18. The destination vent needle 86 is joined via tubing to the destination side vent check valve 88 to prevent the over-pressurization of the destination bottle B.

Thus, the source and destination side vent check valves 82, 88 are valves that are part of a passive system that prevents over-pressurization of the source and destination bottles A, B. If the pressure inside the source and/or destination bottle A, B exceeds approximately 15 psi (1 atm), the respective source and/or destination side vent check valve 82, 88 automatically discharges gas from the respective bottle A, B via the over-pressurization vent 84 to lower the pressure inside the bottle A, B. Control interfaces can be provided between the control system (PLC 70) and the source and destination side vent check valves 82, 88 to govern when the valves 82, 88 discharge the pressurized gas. Thus, the PLC 70 can be programmed to control and monitor the pressure release through the valves 82, 88.

The nitrogen purge valve and control 90 provides a control interface between the control system (PLC 70) and a purge valve for purging the conduits, i.e., the tubes and needles, in the apparatus 1 before the fluid transfer operation. The nitrogen purge valve and control 90 is used to toggle the nitrogen flow on and off for the purge sequence prior to insertion of the needles into the source bottle A. Thus, the PLC 70 can be programmed to control and monitor the nitrogen flow prior to insertion of the needles into the source bottle A.

The main nitrogen valve and control 92 provides a control interface between the control system (PLC 70) and the nitrogen system that supplies nitrogen to the apparatus 1. The main nitrogen valve and control 92 is used to toggle the nitrogen flow on and off for the entire apparatus 1, i.e., supplied to the source bottle A. The PLC 70 can send commands the main nitrogen valve and control 92 to control the valve to adjust the nitrogen flow. Thus, the PLC 70 can be programmed to control and monitor the nitrogen flow into the source bottle A.

In order to prevent contamination, the source intake needle 12, the one-way valves (the source side fluid check valve 14 and the destination side fluid check valve 16), a pump chamber of the pump 10, the destination needle 18, and the destination vent needle 86 can be disposable. When a new bottle of wine is to be transferred as the source bottle A, these disposable components of the apparatus 1 can be removed and replaced by new components.

Thus, in the present invention, the exposure to oxygen is eliminated by keeping the liquid in a closed system as much as possible in the transfer process from the source bottle A to the destination bottle B. Furthermore, the risk of biological contamination is reduced by sterilizing the various components in the apparatus, and rapid evaporation of the liquid is prevented by using a neutral atmosphere of nitrogen at a constant pressure of approximately 15 psi (1 atm).

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An apparatus for transferring a liquid from one location to another location, comprising:

a source container for holding the liquid;

a destination container into which the liquid is transferred;

a liquid transfer mechanism transferring the liquid from the source container to the destination container, the mechanism including;

at least one unidirectional valve between the source container and the destination container preventing backflow into the source container;

a source needle, inserted into a sealed closure of the source container, withdrawing the liquid from the source container;

a destination needle separate from the source needle, inserted into a sealed closure of the destination container, for depositing the liquid into the destination container;

an inert gas container supplying an inert gas to the source container via a conduit;

a driven mechanism for controllably moving the source needle and destination needle relative to the respective container, the mechanism accommodating the conduit that delivers the inert gas to the source container so that movement of the conduit is permitted; and a passive vent system including at least one vent check valve releasing pressure from at least one of the source container and the destination container when the pressure in the respective container exceeds a predetermined pressure limit, the vent check valve opening when a pressure within the container exceeds a threshold pressure;

wherein the source needle and the destination needle are connected to the liquid transfer mechanism to transfer the liquid from the source container to the destination container.

2. The apparatus of claim 1, wherein the destination container is hermetically sealed, sterilized, and contains the inert gas.

3. The apparatus of claim 1, wherein the mechanism includes a needle actuation and support assembly comprising: a guide assembly head attached to a controlled needle, the controlled needle being one of the source needle and the destination needle; a slide guiding the guide assembly head and allowing the guide assembly head and the controlled needle to move in a linear direction; and an actuator driving the guide assembly head so that the controlled needle is driven into a sealed closure of one of the source container and the destination container, wherein the guide assembly head accommodates the conduit that delivers the inert gas.

4. The apparatus of claim 3, further comprising a needle assembly guide comprising: a needle guide guiding the controlled needle into the sealed closure of one of the source container and the destination container; the guide assembly head driving a spring to position the needle guide against one of the source container and the destination container; and at least one guide post guiding the controlled needle during insertion into the sealed closure of one of the source container and the destination container.

5. The apparatus of claim 1, further comprising a cap assembly mounted to the destination container, the cap assembly comprising: a septum closing The destination container and allowing the transfer of liquid via the destination needle inserted through the septum; and an inner cap removably fixed to the destination container, supporting the septum, and holding the septum against the destination container.

6. The apparatus of claim 5, wherein the cap assembly of the destination container further comprises: an outer cap mounted on the inner cap and allowing simultaneous removal of the inner cap and the outer cap when the liquid is dispensed from the destination container; and a secondary seal disposed between the inner cap and the outer cap.

7. The apparatus of claim 1, further including a motorized means for actively transferring the liquid from the source container to the destination container and a second unidirectional valve, wherein the one unidirectional valve is located along a first main conduit that is coupled to the source needle and the motorized means and the second unidirectional valve is located along a second main conduit that is coupled to the destination needle and the motorized means, the second unidirectional valve preventing backflow toward the source container and the motorized means.

8. The apparatus of claim 1, further comprising an inert gas supply regulator, connected between the inert gas container and the source container, maintaining the supply of the inert gas between approximately 10 psi and approximately 20 psi.

9. The apparatus of claim 3, further comprising a control system controlling the actuator to control movement of the controlled needle.

10. The apparatus of claim 1, further comprising a control system controlling a main inert gas valve connected between the inert gas container and the source container to control flow of the inert gas into the source container, wherein the inert gas container is selectively and fluidly connected to both the source needle to permit purging thereof and to a supply needle for delivering the inert gas to the source container.

11. An apparatus for transferring wine without compromising the quality of the wine, comprising:

a source container for containing the wine;

a destination container into which the wine is transferred;

a liquid transfer mechanism transferring the wine from the source container to the destination container, the mechanism including;

at least one unidirectional valve between the source container and the destination container preventing backflow into the source container;

a source needle, inserted into a scaled closure of the source container, withdrawing the wine from the source container;

a destination needle, inserted into a sealed closure of the destination container, depositing the wine into the destination container; wherein the source needle and the destination needle are connected to the liquid transfer mechanism to transfer the wine from the source container to the destination container;

an active needle actuation assembly for controllably moving one of the source needle and the destination needle, the assembly including a guide head that is attached to the needle and is operatively coupled to an actuator that controllably drives the guide head so that the needle is driven into an engaged position resulting in the needle piercing a sealed closure of the container and entering an interior space of the container, a passive needle guide assembly including a needle guide that contacts a top of the container in an engaged position and supports the needle as it pierces the closure, wherein a biasing element disposed between the guide head and the needle guide applies a force to maintain the needle guide at the top of the container both prior to and after insertion of the needle therein.

12. The apparatus for transferring wine of claim 11, further comprising: an inert gas container supplying an inert gas to the source container; and an inert gas supply regulator, connected between the inert gas container and the source container, maintaining the supply of the inert gas at a predetermined pressure.

13. The apparatus for transferring wine of claim 11, farther comprising at least one vent check valve releasing pressure from at least one of the source container and the destination container when the pressure in the respective container exceeds a predetermined pressure limit.

14. The apparatus for transferring wine of claim 13, wherein the predetermined pressure limit is between approximately 10 psi and approximately 20 psi.

15. The apparatus for transferring wine of claim 11, further comprising a slide guiding the guide assembly head and allowing the guide assembly head and the needle to move in a linear direction and guide posts to assist in guiding the needle during insertion, the guide posts surrounding the biasing element which is in the form of a spring.

* * * * *